US011511777B2

(12) United States Patent
Smerecky

(10) Patent No.: US 11,511,777 B2
(45) Date of Patent: Nov. 29, 2022

(54) FRICTION WEDGE WITH IMPROVED BOND CHARACTERISTICS

(71) Applicant: Nevis Industries LLC, Wilmington, DE (US)

(72) Inventor: Jerry R. Smerecky, South Barrington, IL (US)

(73) Assignee: Nevis Industries LLC, Wilmington, DE (US)

( * ) Notice: Subject to any disclaimer, the term of this patent is extended or adjusted under 35 U.S.C. 154(b) by 193 days.

(21) Appl. No.: 16/731,530

(22) Filed: Dec. 31, 2019

(65) Prior Publication Data

US 2020/0207380 A1 Jul. 2, 2020

Related U.S. Application Data

(60) Provisional application No. 62/786,694, filed on Dec. 31, 2018.

(51) Int. Cl.

| | |
|---|---|
| ***B61F 5/12*** | (2006.01) |
| ***B61F 5/02*** | (2006.01) |
| ***B61F 5/50*** | (2006.01) |

(52) U.S. Cl.

CPC ..... *B61F 5/122* (2013.01); *B61F 5/02* (2013.01); *B61F 5/50* (2013.01)

(58) Field of Classification Search

CPC .... B61F 5/122; B61F 5/04; B61F 5/00; B61F 5/02; B61F 5/12; B61F 5/14; B61F 5/32; B61F 5/34; B61F 5/50; F16F 2226/04

See application file for complete search history.

(56) References Cited

U.S. PATENT DOCUMENTS

| | | | | |
|---|---|---|---|---|
| 4,915,031 | A * | 4/1990 | Wiebe | B61F 5/122 105/198.2 |
| 6,971,319 | B2 * | 12/2005 | Bowden | B61F 5/32 105/198.5 |
| 7,143,700 | B2 * | 12/2006 | Forbes | B61F 5/50 105/223 |
| 8,869,709 | B2 * | 10/2014 | East | B61F 5/50 105/198.2 |
| 2002/0079279 | A1 | 6/2002 | Duncan et al. | |
| 2018/0162424 | A1 | 6/2018 | Aleynikov et al. | |

FOREIGN PATENT DOCUMENTS

| | | |
|---|---|---|
| AU | 2010282787 A1 | 3/2012 |

OTHER PUBLICATIONS

Apr. 30, 2020—(WO) ISR and WO—App. No. PCT\US19\69094.

* cited by examiner

*Primary Examiner* — Zachary L Kuhfuss
*Assistant Examiner* — Cheng Lin
(74) *Attorney, Agent, or Firm* — Banner & Witcoff, Ltd.

(57) ABSTRACT

A friction wedge with improved bond characteristics may include a friction wedge body and a friction wedge liner. The friction wedge body may include a pattern formed by a ridge or elevation disposed on a connecting face of the friction wedge body. The friction wedge liner may include a complementary pattern formed by a channel disposed on a bonding surface of the friction wedge liner.

20 Claims, 6 Drawing Sheets

FRICTION WEDGE WITH IMPROVED BOND CHARACTERISTICS

CROSS-REFERENCE TO RELATED APPLICATIONS

This patent application claims the benefit of U.S. Provisional Application No. 62/786,694 filed Dec. 31, 2018, entitled Friction Wedge with Improved Bond Characteristics which is incorporated by reference herein in its entirety.

FIELD

Aspects described herein generally relate to a friction wedge for railway cars. More specifically, aspects relate to a friction wedge body with a pattern defined by a ridge or elevation disposed on the connecting face of the friction wedge body. Aspects further relate to a friction wedge liner with a pattern defined by a channel disposed on the bonding surface of the friction wedge liner that is complementary to the pattern disposed on the connecting face of the friction wedge body. Aspects also relate to improved bonding techniques that utilize the patterns to optimize the strength and characteristics of the bond between the friction wedge body and the friction wedge liner. Aspects further relate to methods of manufacture of friction wedges, including friction wedge bodies and friction wedge liners having the bonding patterns described herein.

BACKGROUND

Railway cars typically consist of a rail car that rests upon a pair of truck assemblies. The truck assemblies include a pair of side frames and wheelsets connected together via a bolster and damping system. The car rests upon the center bowl of the bolster, which acts as a point of rotation for the truck system. The railway car body movements are reacted through the springs and friction wedges, which connect the bolster and side frames. The side frames include pedestals that each define a jaw into which a wheel assembly of a wheel set is positioned using a roller bearing adapter. Additionally, the side frames include bolster openings through which the bolster, and the springs and friction wedges attached thereto, are assembled into. During operation, a surface of the friction wedge typically moves along a surface of a friction wear plate attached to the side frame. The friction wedge may move laterally along the friction wear plate. The friction wedge may also move vertically along the friction wear plate.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of this disclosure are directed to friction wedges having increased performance abilities. Specifically, aspects of the disclosure are directed to bonding techniques that optimize the strength and characteristics of the bond between the friction wedge body and the friction wedge liner.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein.

DETAILED DESCRIPTION

Figures 1A, 1B:
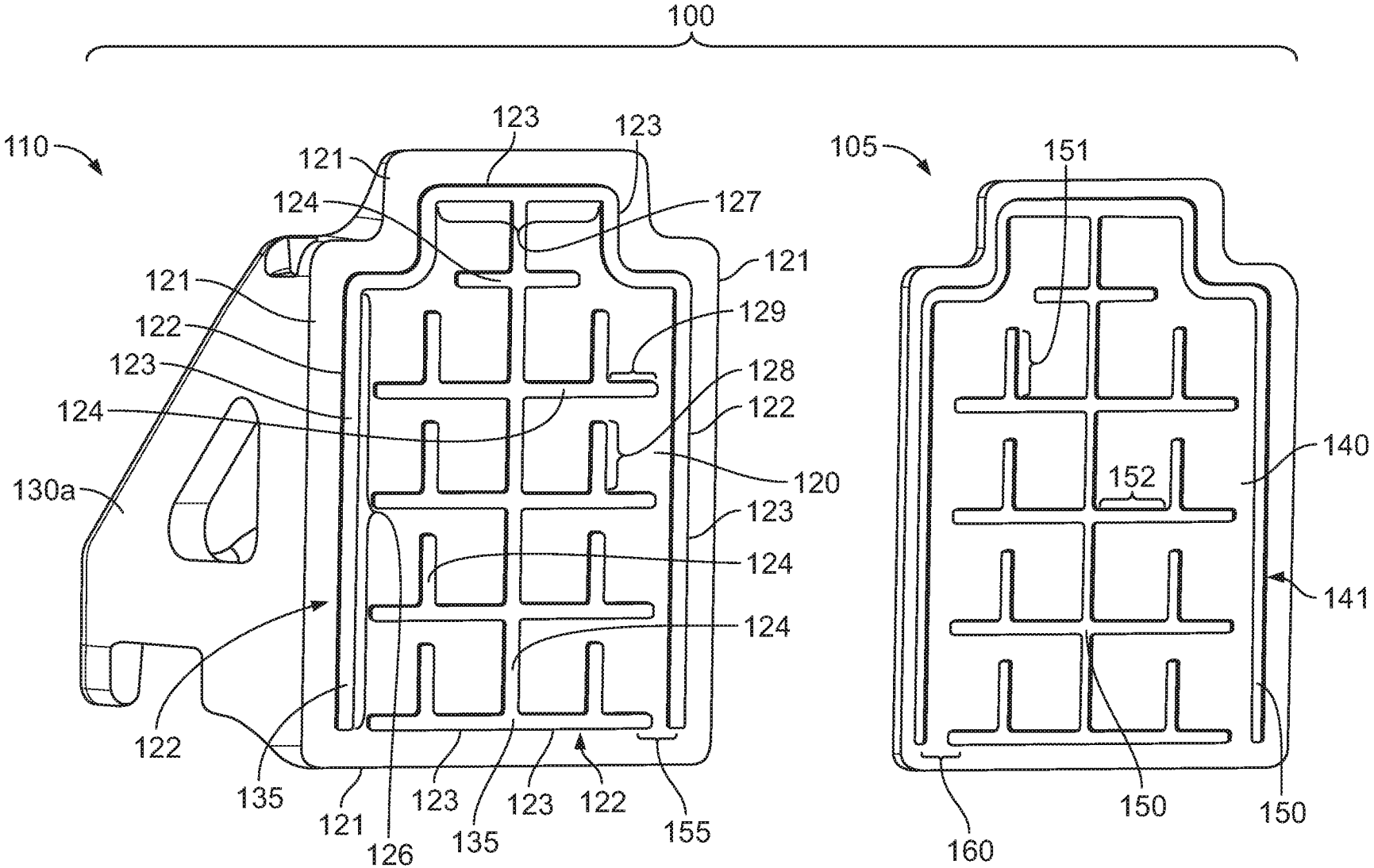
FIG. 1A illustrates a perspective view of an exemplary friction wedge body according to one or more aspects of the disclosure.
FIG. 1B illustrates a perspective view of an exemplary friction wedge liner according to one or more aspects of the disclosure.
Figure 1C:
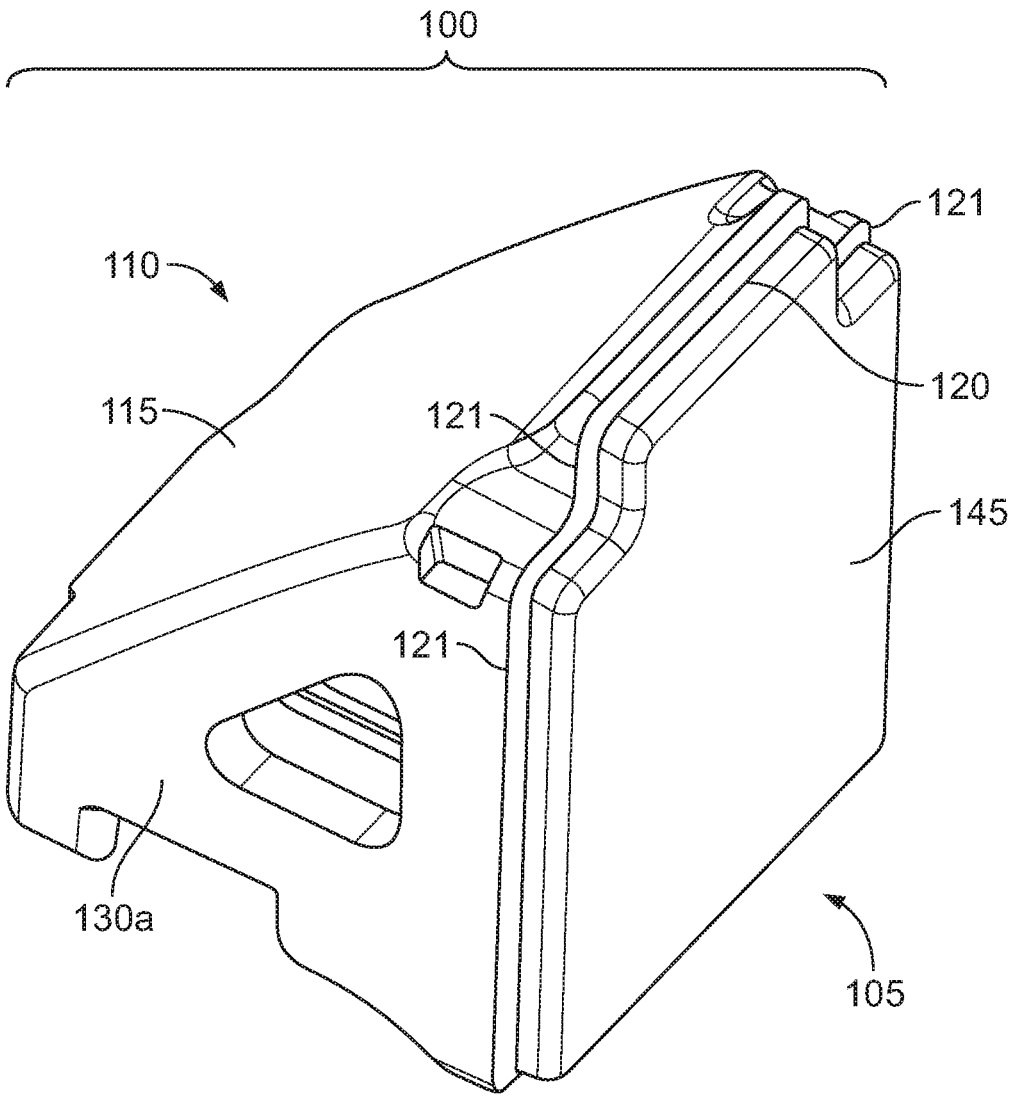
FIGS. 1C and 1D illustrate perspective views of an exemplary friction wedge body and friction wedge liner according to one or more aspects of the disclosure.
Figure 1D:
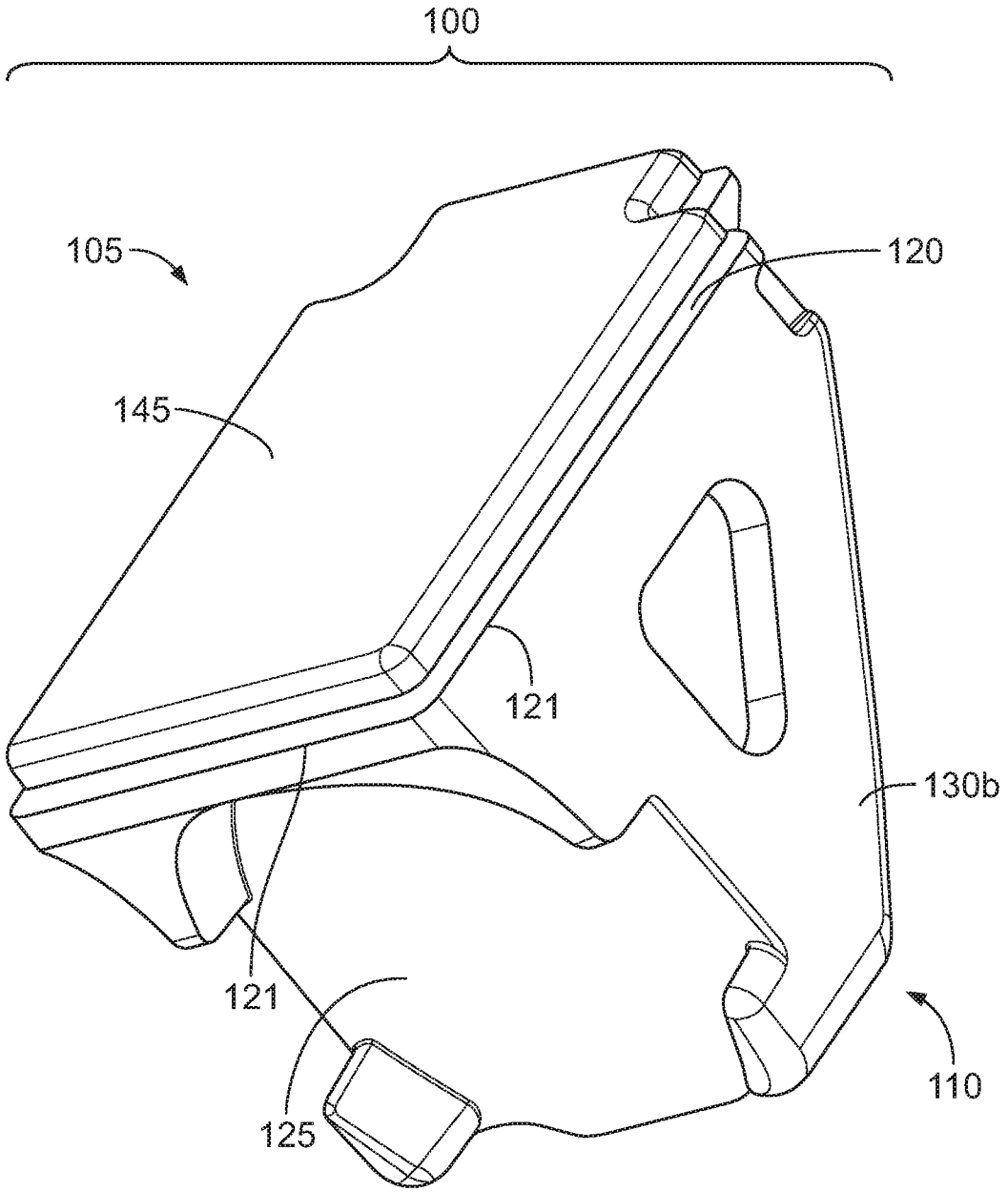

In the following description of the various embodiments, reference is made to the accompanying drawings, which form a part hereof, and in which is shown by way of illustration various embodiments in which aspects described herein may be practiced. It is to be understood that other embodiments may be utilized and structural and functional modifications may be made without departing from the scope of the described aspects and embodiments. Aspects described herein are capable of other embodiments and of being practiced or being carried out in various ways. Also, it is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof as well as additional items and equivalents thereof. The use of the terms "mounted," "connected," "coupled," "positioned," "engaged" and similar terms, is meant to include both direct and indirect mounting, connecting, coupling, positioning and engaging.

Also, while the terms "top," "bottom," "front," "back," "side," "rear," "upward," "downward," and the like may be used in this specification to describe various example features and elements of the disclosure, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this disclosure. Also, the reader is advised that the attached drawings are not necessarily drawn to scale.

FIGS. 1A-1D illustrate perspective views of various portions of a friction wedge 100 of a railway car truck assembly (not shown). As shown in FIGS. 1A-1D, the friction wedge 100 may include a friction wedge liner 105 and a friction wedge body 110.

The friction wedge body 110 may include a sloped face 115, a connecting face 120, a bottom face 125, and two side faces 130*a*, 130*b*. The connecting face 120 may be defined by a connecting face perimeter 121. The connecting face perimeter 121 may include a number of straight vertical portions and straight horizontal portions. The connecting face perimeter 121 may also include a number of curved portions. The friction wedge body 110 may have a connecting face pattern 122 formed by a ridge or elevation 135 disposed on the surface of the connecting face 120. The connecting face pattern 122 may include a connecting face outer pattern perimeter portion 123, and a connecting face inner pattern portion 124 that is generally within the outer pattern perimeter portion 123. The connecting face outer pattern perimeter portion 123 may form substantially the same shape as the connecting face perimeter 121. The connecting face inner pattern portion 124 may be closer to the center of the connecting face 120 than the connecting face outer pattern perimeter portion 123. According to one embodiment illustrated in FIG. 1A, the pattern formed by the ridge or elevation 135 may be continuous and may include connecting face pattern interruptions 155 in the connecting face pattern 122 wherein portions of the ridge 135 do not connect to adjacent portions of the ridge 135. According to other embodiments, ridge or elevation 135 may form a continuous pattern without any connecting face pattern interruptions 155, and in still other embodiments the ridge or elevation 135 may comprise multiple ridges or elevations. The friction wedge body 110 may be made of various materials of desired strength and performance, such as, but not limited to, metals such as iron or steel (including metal alloys) or composites.

The friction wedge liner 105 may include a bonding surface 140 and a friction surface 145. The bonding surface 140 is shown in FIG. 1B. The bonding surface 140 of the friction wedge liner 105 may have a bonding surface pattern 141 defined by a channel 150 on the bonding surface 140 that is complementary to the connecting face pattern 122 formed by the ridge or elevation 135 on the friction wedge body 110. The channel 150 on the bonding surface 140 of the friction wedge liner 105 may be sized and configured to receive the ridge or elevation 135 disposed on the connecting face 120 of the friction wedge body 110 and/or the channel 150 on the bonding surface 140 of the friction wedge liner 105 may be formed by the ridge or elevation 135. In some embodiments, the bonding surface pattern 141 of channel 150 may also include bonding surface pattern interruptions 160 wherein portions of the channel 150 do not connect to adjacent portions of the channel 150. As described above, this is only one exemplary embodiment, and the channel 150 may include more bonding surface pattern interruptions 160 or may not include any bonding surface pattern interruptions 160. The friction wedge liner 105 may be made of various materials, such as, but not limited to, metals (including metal alloys), plastics, polymers, and composites. More specific example materials may include rubber, plastics, elastomers, thermoplastic elastomers (TPE), and polypropylene (PP), stainless steel, and titanium (including titanium alloys).

Figure 2:
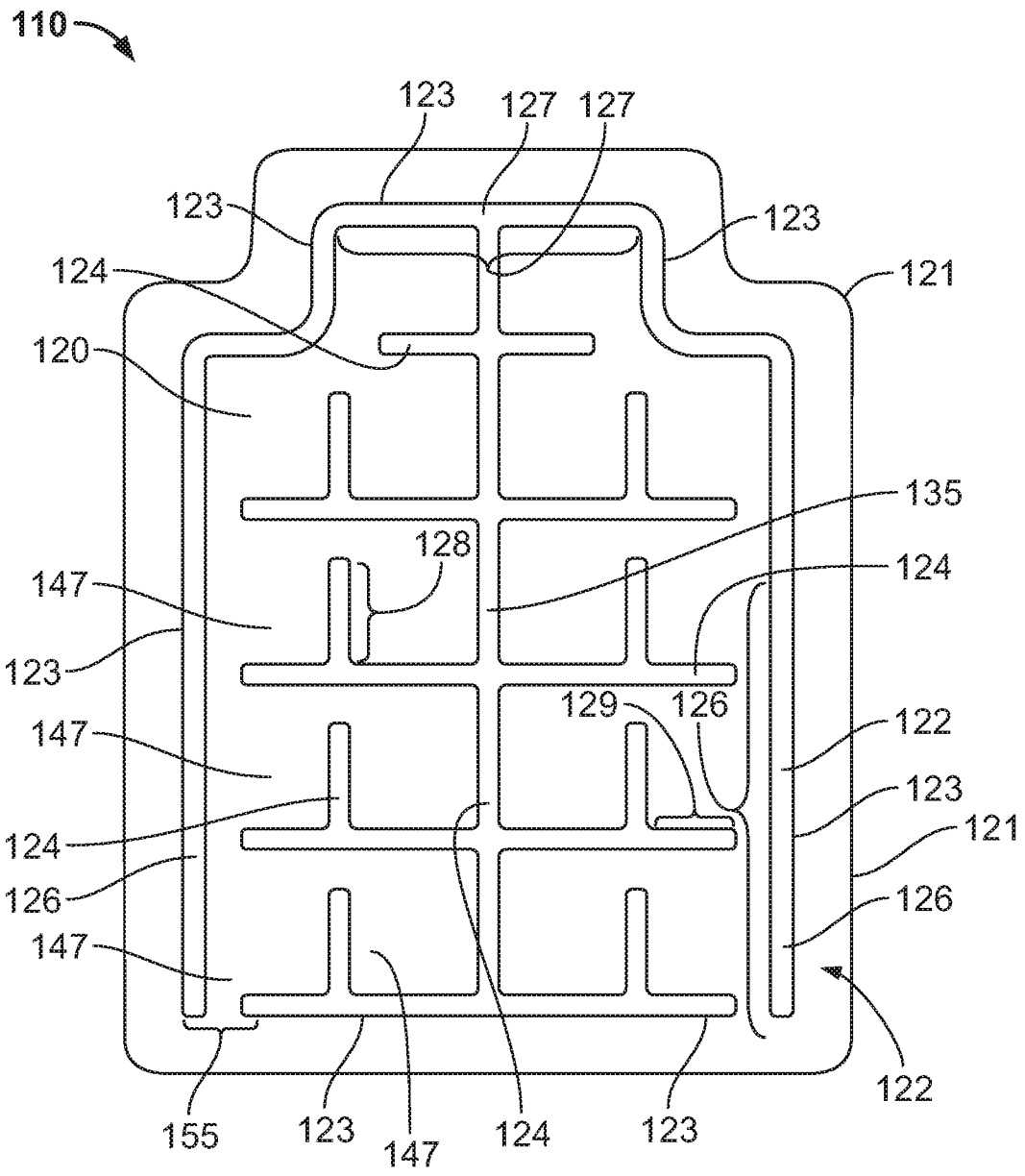
FIG. 2 illustrates a front view of an exemplary connecting face of a friction wedge body according to one or more aspects of the disclosure.
Figure 3:
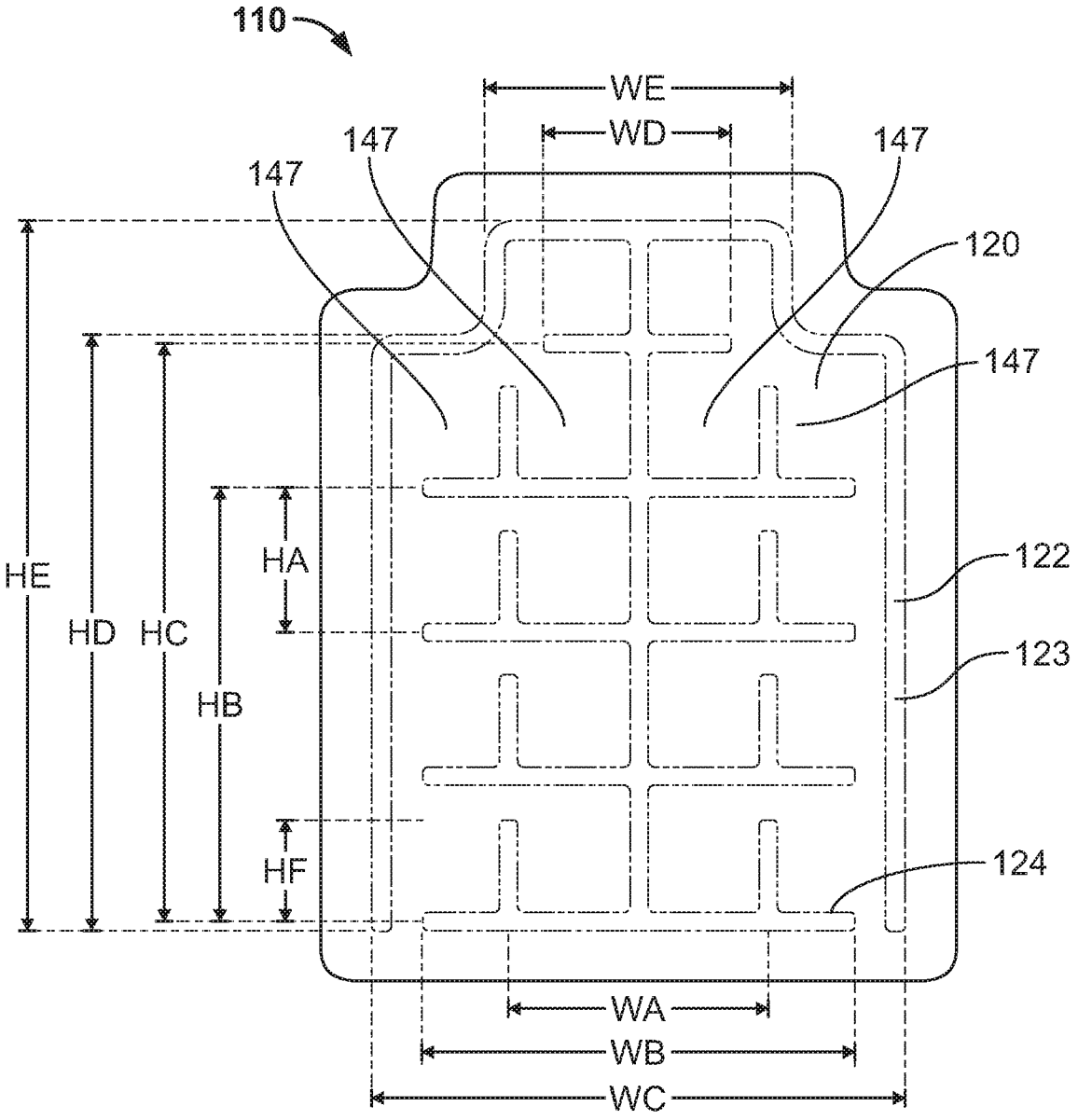
FIG. 3 illustrates a front view of a connecting face of a friction wedge body and exemplary dimensions for the ridge or elevation disposed on the connecting face according to one or more aspects of the disclosure.

FIGS. 2-3 illustrate one embodiment of the connecting face pattern 122 formed by ridge or elevation 135 disposed on the connecting face 120 of the friction wedge body 110. As noted above, the connecting face pattern 122 may include a connecting face outer pattern perimeter portion 123 and a connecting face inner pattern portion 124. As shown in FIGS. 2-3, the connecting face pattern 122 formed by the ridge or elevation 135 may be composed of a number of substantially vertical and horizontal portions. The connecting face outer pattern perimeter portion 123 may include a number of connecting face vertical perimeter portions 126 and connecting face horizontal perimeter portions 127. The connecting face inner pattern portion 124 may include a number of connecting face vertical inner portions 128 and connecting face horizontal inner portions 129. The relative spacing and location of the ridge or elevation 135 portions may be important to the optimal bond characteristics between the friction wedge liner 105 and friction wedge body 110. A number of interconnected connecting face retention units 147 are formed by portions of the connecting face outer pattern perimeter portion 123 and/or the connecting face inner pattern portion 124 of the connecting face pattern 122. Each unit 147 is generally defined by two horizontal and two vertical ridge or elevation 135 portions. Each of the ridge or elevation 135 portions may be connected or unconnected to an adjacent ridge or elevation portion. Advantageously, because each of the connecting face retention units 147 are interconnected with each other (i.e. each unit has at least one ridge or elevation portion that does not connect to an adjacent portion), the bond between the friction wedge body 110 and friction wedge liner 105 may be increased. As shown in FIG. 3, each unit 147 may have a height ("HA"). Two units 147 may also have a width ("WA"), and thus each unit 147 may have a width of (0.5*WA). The top portion of the connecting face outer pattern perimeter portion 123 formed by the ridge or elevation 135 may have a width ("WE") that is smaller than the width of the bottom portion of the connecting face outer pattern perimeter portion 123 ("WC"). Further, according to one embodiment of the disclosure, the connecting face pattern interruptions 155 may have a combined width of slightly less than the difference between WC and WB. Three units 147 formed by the ridge or elevation 135 of one embodiment of the disclosure may have a height ("HB"), while four units formed by the ridge or elevation 135 may have a larger height ("HC"). The connecting face pattern 122 formed by the ridge or elevation 135 may have a total height ("HE"). Further, according to one embodiment of the disclosure, the ridge or elevation 135 may have a certain height that is approximately the difference between HD and HC. Some units may have an incomplete bottom portion. The width of the ridge or elevation 135 portion of each such unit may be about (0.5*WD) Likewise, according to some embodiments, some units may have an incomplete side portion. The height of the ridge or elevation 135 portion of each such unit may be about (HF). As shown below in Table 1, these heights and widths may have specific ratios of dimensions that may increase the performance of bond between the friction wedge body 110 and friction wedge liner 105.

TABLE 1

Ratios of Dimensions of Ridge or Elevation 135 Disposed on Connecting Face 120

| Description | Ratios of Dimensions |
|---|---|
| Ratio of HD to WC – [(HD)/(WC)] | 1; or about 0.8 to about 1.2 |
| Ratio of HA to WA – [(HA)/(WA)] | 0.5; or about 0.4 to about 0.6 |
| Ratio of HF to WD – [(HF)/(WD)] | 0.5; or about 0.4 to about 0.6 |
| Ratio of HB to WA – [(HB)/(WA)] | 1.5; or about 1.2 to about 1.8 |
| Ratio of HE to WC – [(HE)/(WC)] | 1.25; or about 1 to about 1.5 |

Figure 4:
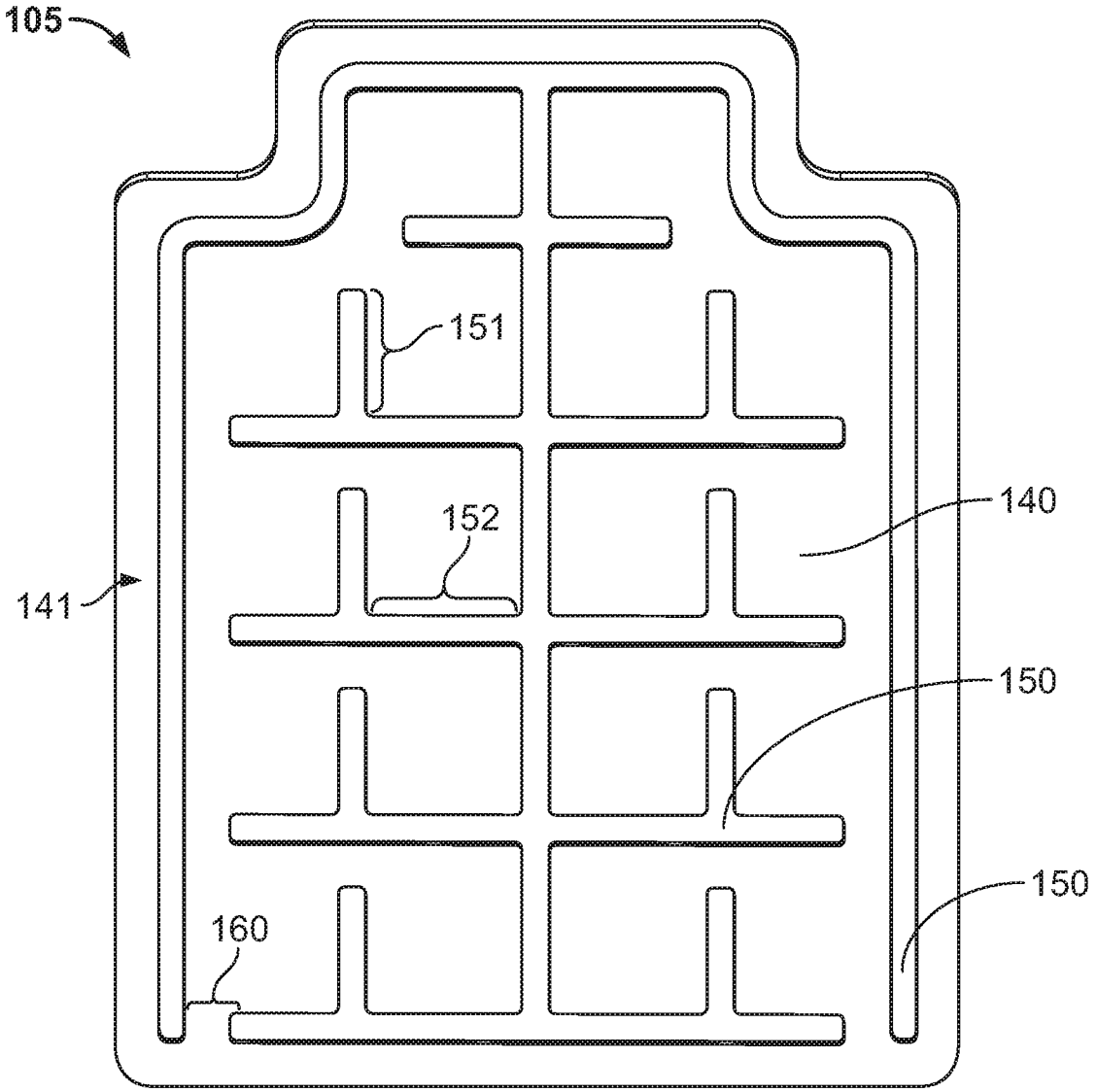
FIG. 4 illustrates a front view of an exemplary bonding surface of a friction wedge liner according to one or more aspects of the disclosure.

FIG. 4 illustrates one embodiment of the bonding surface pattern 141 formed by channel 150 disposed on the bonding surface 140 of the friction wedge liner 105. According to this embodiment, the bonding surface pattern 141 includes bonding surface pattern interruptions 160. As described above, this is only exemplary, and the bonding surface pattern 141 defined by the channel 150 may include more bonding surface pattern interruptions 160 or may not include any interruptions 160. The bonding surface pattern 141 defined by the channel 150 may include a number of bonding surface vertical portions 151 and bonding surface horizontal portions 152. The bonding surface pattern 141 defined by the channel 150 may be complementary to the connecting face pattern 122 formed by the ridge or elevation 135 on the connecting face 120 such that the channel 150 receives and securely fits over top of the ridge or elevation 135. The complementary bonding surface pattern 141 advantageously provides increased support when the friction wedge moves laterally or vertically along a friction wear plate attached to a side frame (not shown). This is because the connecting face vertical perimeter portions 126 and the connecting face vertical inner portions 128 of the connecting face pattern 122 formed by the ridge or elevation 135 and the bonding surface vertical portions 151 of the bonding surface pattern 141 formed by the channel 150 are perpendicular to a lateral force factor experienced by the friction wedge 100 when the friction surface 145 moves laterally along a friction wear plate. Likewise, the connecting face horizontal perimeter portions 127 and the connecting face horizontal inner portions 129 of the connecting face pattern 122 formed by the ridge or elevation 135 and the bonding surface horizontal portions 152 of the bonding surface pattern 141 formed by the channel 150 are perpendicular to a vertical force factor experienced by the friction wedge 100 when the friction surface 145 moves vertically along a friction wear plate. This orientation results in increased bond characteristics between the friction wedge body 110 and the friction wedge liner 105, thereby increasing performance of the friction wedge 100. As described above, according to some embodiments, the substantially uniform nature and repetition of the connecting face retention units 147 formed by portions of the connecting face outer pattern perimeter portion 123 and/or the connecting face inner pattern portion 124 of the connecting face pattern 122 may provide additional support, thereby increasing bond characteristics and performance of the friction wedge 100.

In alternative embodiments the channel and ridge may be reversed such that the friction wedge liner 105 includes a ridge or elevation and the friction wedge body 110 includes a corresponding channel. For example, the pattern formed on the connecting face 120 of the friction wedge body 110 may comprise a channel, similar to the one shown on the bonding surface 140 of the friction wedge liner 105 in FIG. 4. According to this embodiment, the friction wedge liner 105 may have a pattern formed by a ridge or elevation disposed on the bonding surface 140 of the friction wedge liner 105 that is complementary to the pattern formed by the channel on the connecting face 120 of the friction wedge body 110. The patterns of this embodiment are not limited to the pattern shown in FIG. 4, and may comprise alternative patterns consistent with this disclosure. In still other alternative embodiments the friction wedge liner 105 may include both a channel 150 and bonding surface ridges and the friction wedge body 110 may include a corresponding ridge 135 and connecting face channels.

The friction wedge 100 may be manufactured using many methods. In one example, the friction wedge body 110 including the ridge or elevation 135 may be cast using known methods. In one example, multiple friction wedges 100 may be cast at one time using a core having opposite sides to mold the friction wedge connecting face 120. In another example the friction wedge body 110 may be cast and the ridge or elevation 135 may be attached to the friction wedge connecting face 120. In some embodiments the ridge or elevation 135 may be attached to the friction wedge connecting face 120 in a number of ways including, but not limited to, by welding, adhesion via glue, polymer, or epoxy materials, and/or mechanical fit.

Once the friction wedge body 110 is formed, friction wedge liner 105 material in liquid or powder form may be poured into a mold on the connecting face 120 of the friction wedge body 110. The friction wedge liner 105 material may then be heated and/or pressurized to harden the friction wedge liner 105 and to bond the friction wedge liner 105 to the friction wedge body 110. To the extent necessary, excess friction wedge liner 105 material may be removed according to known techniques to arrive at a desired shape.

According to an alternative method of manufacture the friction wedge liner 105 may be formed separately from the friction wedge body 110. Once the friction wedge liner 105 is formed, the bonding surface 140 of the friction wedge liner 105 may be bonded to the connecting face 120 of the friction wedge body 110. Bonding may occur in a number of ways, including, but not limited to, by welding, adhesion via glue, polymer, or epoxy materials, and/or mechanical fit.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. A friction wedge for use in a railway car truck assembly, the friction wedge comprising:

a friction wedge body, the friction wedge body comprising:
- a sloped face;
- a plurality of side faces;
- a bottom face; and
- a connecting face defined by a connecting face perimeter, the connecting face comprising:
  - a ridge disposed on the connecting face; and
  - a connecting face pattern defined by the ridge, the connecting face pattern comprising:
    - a connecting face outer pattern perimeter portion, wherein the connecting face outer pattern perimeter portion forms substantially the same shape as the connecting face perimeter, and wherein the connecting face outer pattern perimeter portion is spaced inward from the connecting face perimeter;
    - a connecting face inner pattern portion; and
  - a plurality of connecting face retention units defined by the connecting face pattern; and a friction wedge liner, the friction wedge liner comprising:
- a friction surface; and
- a bonding surface, the bonding surface comprising:
  - a channel disposed on the bonding surface; and
  - a bonding surface pattern defined by the channel, wherein the bonding surface pattern is configured to be complementary to the connecting face pattern to allow the channel to receive the ridge of the connecting face.

2. The friction wedge of claim 1, wherein one of the connecting face retention units has a height and a width that are equal.

3. The friction wedge of claim 1, wherein one of connecting face retention units has a height and a width that are not equal and that have a ratio in the range of 1.2 to 0.8.

4. The friction wedge of claim 1, wherein the connecting face outer pattern perimeter portion comprises a plurality of connecting face horizontal perimeter portions configured to be perpendicular to a vertical force factor experienced by the friction wedge when the friction surface moves vertically along a friction wear plate of the railway car truck assembly.

5. The friction wedge of claim 4, wherein the connecting face inner pattern portion comprises a plurality of connecting face horizontal inner portions configured to be perpendicular to the vertical force factor experienced by the friction wedge when the friction surface moves vertically along the friction wear plate of the railway car truck assembly.

6. The friction wedge of claim 1, wherein the connecting face outer pattern perimeter portion comprises a plurality of connecting face vertical perimeter portions configured to be perpendicular to a lateral force factor experienced by the friction wedge when the friction surface moves laterally along a friction wear plate of the railway car truck assembly.

7. The friction wedge of claim 6, wherein the connecting face inner pattern portion comprises a plurality of connecting face vertical inner portions configured to be perpendicular to the lateral force factor experienced by the friction wedge when the friction surface moves laterally along the friction wear plate of the railway car truck assembly.

8. The friction wedge of claim 1, wherein the connecting face pattern comprises a connecting face pattern interruption.

9. The friction wedge of claim 8, wherein the bonding surface pattern comprises a bonding surface pattern interruption.

10. The friction wedge of claim 1, wherein the connecting face further comprises a plurality of connecting face channels.

11. The friction wedge of claim 10, wherein the bonding surface further comprises a plurality of bonding surface ridges configured to be complementary to the connecting face channels to allow the connecting face channels to receive the bonding surface ridges.

12. The friction wedge of claim 1, wherein the friction wedge body is comprised of a metal, a metal alloy, or a composite material.

13. The friction wedge of claim 1, wherein the bonding surface of the friction wedge liner is bonded to the connecting face of the friction wedge body by at least one of: by welding, by adhesion via glue, polymer, or epoxy materials, or by mechanical fit.

14. A friction wedge for use in a railway car truck assembly, the friction wedge comprising:

a friction wedge body, the friction wedge body comprising:
- a sloped face;
- a plurality of side faces;
- a bottom face; and
- a connecting face defined by a connecting face perimeter, the connecting face comprising:
  - a channel disposed on the connecting face; and
  - a connecting face pattern defined by the channel, the connecting face pattern comprising:
    - a connecting face outer pattern perimeter portion, wherein the connecting face outer pattern perimeter portion forms substantially the same shape as the connecting face perimeter, and wherein the connecting face outer pattern perimeter portion is spaced inward from the connecting face perimeter;
    - a connecting face inner pattern portion; and
    - a plurality of connecting face retention units defined by the connecting face pattern; and a friction wedge liner, the friction wedge liner comprising:
- a friction surface; and
- a bonding surface, the bonding surface comprising:
  - a ridge disposed on the bonding surface; and
  - a bonding surface pattern defined by the ridge, wherein the bonding surface pattern is configured to be complementary to the connecting face pattern to allow the channel to receive the ridge of the bonding surface.

15. The friction wedge of claim 14, wherein one of connecting face retention units has a height and a width that are equal.

16. The friction wedge of claim 14, wherein one of connecting face retention units has a height and a width that are not equal and that have a ratio in the range of 1.2 to 0.8.

17. The friction wedge of claim 14, wherein the connecting face outer pattern perimeter portion comprises a plurality of connecting face horizontal perimeter portions configured to be perpendicular to a vertical force factor experienced by the friction wedge when the friction surface moves vertically along a friction wear plate of the railway car truck assembly.

18. The friction wedge of claim 14, wherein the connecting face outer pattern perimeter portion comprises a plurality of connecting face vertical perimeter portions configured to be perpendicular to a lateral force factor experienced by the friction wedge when the friction surface moves laterally along a friction wear plate of the railway car truck assembly.

19. The friction wedge of claim 14, wherein the connecting face pattern comprises a connecting face pattern interruption.

20. A friction wedge body for use in a friction wedge assembly, the friction wedge body comprising:
- a sloped face;
- a plurality of side faces;
- a bottom face; and
- a connecting face defined by a connecting face perimeter, the connecting face comprising:
  - a ridge disposed on the connecting face; and
  - a connecting face pattern defined by the ridge, the connecting face pattern comprising:
    - a connecting face outer pattern perimeter portion, wherein the connecting face outer pattern perimeter portion forms substantially the same shape as the connecting face perimeter, and wherein the connecting face outer pattern perimeter portion is spaced inward from the connecting face perimeter;
    - a connecting face inner pattern portion; and
    - a plurality of connecting face retention units defined by the connecting face pattern.

* * * * *